US005857679A

United States Patent [19]

Ringe et al.

[11] Patent Number: 5,857,679

[45] Date of Patent: Jan. 12, 1999

[54] TENNIS REBOUND NET

[76] Inventors: Thomas Ringe; Cynthia Ringe, both of 235 N. Aberdeen Ave., Wayne, Pa. 19087

[21] Appl. No.: 848,019

[22] Filed: Apr. 28, 1997

Related U.S. Application Data

[63] Continuation of Ser. No. 557,331, Nov. 14, 1995, abandoned.

[51] Int. Cl.[6] ..... A63B 69/00; A63B 69/38

[52] U.S. Cl. ..... 273/395; 473/435

[58] Field of Search ..... 273/400, 396, 273/410; 473/454, 435, 104

[56] References Cited

U.S. PATENT DOCUMENTS

| | | | |
|---|---|---|---|
| 4,082,271 | 4/1978 | Martin | 273/29 A |
| 4,140,313 | 2/1979 | Martin | 273/29 A |
| 4,456,251 | 6/1984 | Balaz | 273/29 A |
| 4,693,472 | 9/1987 | Newman et al. | 273/264 |
| 4,842,284 | 6/1989 | Rushing et al. | 273/395 |

FOREIGN PATENT DOCUMENTS

| | | | |
|---|---|---|---|
| 397260 | 8/1933 | United Kingdom | 273/26 A |

*Primary Examiner*—Mark S. Graham

*Attorney, Agent, or Firm*—Duane, Morris & Hecksher LLP

[57] ABSTRACT

A portable rebound net using a tension adjustable elastic net material lashed to a frame structure is provided. Adjusting the tension of the elastic netting material allows the user to alter the return speed of a ball hit against the rebound net.

13 Claims, 2 Drawing Sheets

TENNIS REBOUND NET

This is a Continuation application of application Ser. No. 08/557,331, filed Nov. 14, 1995, abandoned.

FIELD OF THE INVENTION

This invention relates to practice rebound net devices, and more particularly to a portable and adjustable rebound net which can be used for practicing tennis strokes.

BACKGROUND OF THE INVENTION

Individuals who play racquet sports, in particular tennis, often find they are restricted to practicing when a partner is available to return the ball. In order to alleviate this time restriction, rebound devices or tools of various types have been sought out and used by athletes.

For example, players will often search for a simple brick wall or building to hit a ball against. One primary feature of using a rebound device, such as a brick wall, is the essentially continual availability of the practice "partner." Indeed, one advantage of a rebound device is that the "partner" never tires or complains.

In tennis, as in other racquet sports, repetition is a foundation of practice. A rebound device provides the ability to repeatedly practice a particular stroke or technique because the ball automatically returns to the athlete—assuming the ball is correctly hit to the rebound device. Moreover, repetition is easily accomplished because a rebound device will return the ball the same way each time.

While repetition is the foundation of practice, the ability to vary the type of stroke or return being practiced is a feature that is equally important to athletes. A device that does not provide the ability to vary the practice shots, will soon be discarded as boring and of little use. The variations preferably required of a rebound device include return angle and return speed of the ball hit against the rebound surface.

Rebound nets have been designed to provide certain adjustment to the return characteristics of the ball including the return angle and the return speed. One example of the tennis rebound net prior art is Balaz, U.S. Pat. No. 4,456,251, *Tennis Ball Rebound Practice Net,* disclosing tennis training equipment comprising a partially elastic net supported by a frame structure. The Balaz device specifically teaches the use of elastic vertical net elements while the horizontal net elements are inelastic. Because the horizontal net elements are inelastic, nonuniform tensioning of the net can result, which in turn, could cause inconsistent return characteristics.

Two other examples of rebound net devices include Martin, U.S. Pat. No. 4,140,313, *Net Rebound Wall Adapter For Tennis Enclosure,* and Martin, U.S. Pat. No. 4,082,271, *Tennis Practice And Teaching Rebounder.* The Martin '313 patent teaches a tennis ball rebound net structure that attaches to and is supported by a fence. As described in the Martin '313 patent, the rebound net is hung from cantilever arms supported at the top of a fence structure. The fence structure described in Martin '313 is the typical chain link fencing found surrounding public tennis courts.

Through the use of extensible and retractable pivoting arm members, the Martin '313 device provides the user with a limited ability to adjust the rebound net angle and vertical net tension. The Martin '313 device can only be used where a large and strong fence structure is available to support the net and frame, i.e., a public tennis court. Similar to the Balaz device, the Martin '313 rebound net provides no means of varying the horizontal tension of the net.

A limitation of the Martin '313 device is the requirement for a fence support. This is addressed in the Martin '271 patent. In Martin '271, a tennis teaching rebounder comprising a free-standing frame structure is disclosed. This device permits the user to adjust the vertical tension and vertical angle of the net.

As described and illustrated in the Martin '271 patent, two turnbuckles are used to tension the net in the vertical direction. Moreover, sliding the turnbuckles along lower frame members adjusts the vertical angle of the net. As described in the Martin '271 patent, there is no ability to vary the tension of the horizontal net elements.

Moreover, as disclosed, the Martin '271 device is a large piece of equipment, with the net itself measuring 9 feet in height by 10 to 16 feet in width. Due to its design, the Martin '271 frame structure is substantially larger than the net. As illustrated, the Martin '271 device is for use on a tennis court.

These devices generally describe representative examples of the prior art rebound net devices. In comparison to this prior art, it would be desirable to have a rebound net device that is portable, yet durable and sturdy, in addition to offering complete adjustment of the return angle of the rebounded ball, and adjustment of both the horizontal and vertical rebound net elements. Such results have not been achieved in the rebound net prior art.

SUMMARY OF THE INVENTION

The above-described deficiencies exhibited by the prior art rebound nets are solved by the adjustable rebound net provided in accordance with the present invention.

In a preferred embodiment, the present invention portable rebound net comprises a frame structure, an elastic netting material, having variable tension, lashed to the frame structure, and adjustment means for lashing the elastic netting material to the frame structure and for varying the elastic netting material tension. In a further preferred embodiment, the portable rebound net further comprises support legs pivotally attached to the frame structure for tilting the frame structure and elastic net thereby varying the return angle of the rebounded ball. In another preferred embodiment, the adjustment means is an inelastic cord material. In a still further preferred embodiment, the rebound net further comprises a horizontal tape integrated into the elastic net material to simulate a tennis net top edge.

A method of manufacturing a portable rebound net in accordance with the present invention comprises weaving a cord material around a frame structure and elastic net material, such that the elastic net material is stretched across the frame structure, and tieing the cord material to the frame structure, such that the elastic net material tension may be varied by tightening or loosening the cord material where tied to the frame structure.

Rebound nets according to the present invention will provide the superior characteristics desired of a practice tool. In particular, uniform rebound characteristics of the returned ball will result, in part, because of the uniform tension of the vertical and horizontal elastic net elements. A portable and adjustable rebound net with these features has not heretofore been accomplished in the art.

The invention will be best understood by reading the following detailed description of preferred embodiments in conjunction with the drawings briefly described below.

BRIEF DESCRIPTION OF THE DRAWINGS

For illustration purposes, the attached drawings show presently preferred forms of the invention. It should be understood, however, that the invention is not limited to the precise arrangement and instrumentality shown in these drawings.

DETAILED DESCRIPTION OF THE PREFERRED EMBODIMENTS

Figure 1:
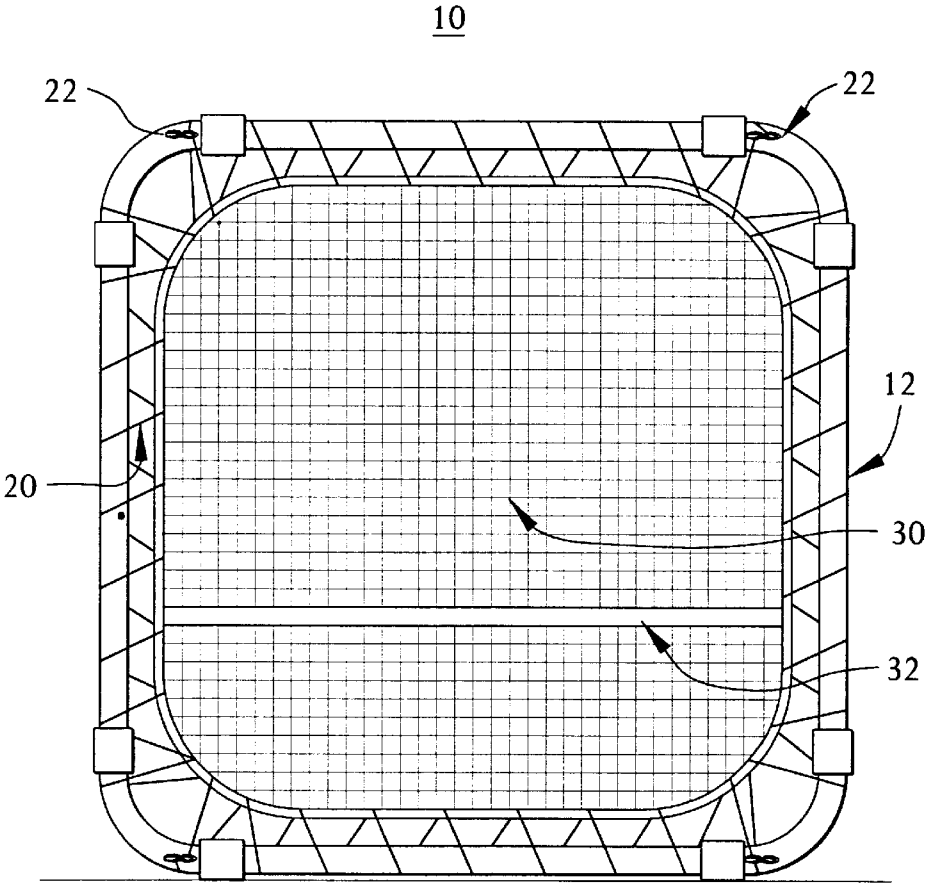
FIG. 1: is a front view of a preferred embodiment of the rebound net and frame structure.

Referring to the drawings where like reference numerals refer to like elements, the present invention is an adjustable and portable rebound net device 10. Preferably, the primary rebound net elements include a frame structure 12, an elastic netting material 30, and a means of adjusting the tension of the elastic netting material held within the frame structure. The rebound net device 10 size and shape are generally defined by the frame structure 12. As shown in FIG. 1, the frame structure 12 preferably is rectangular in shape. While the FIG. 1 frame structure 12 is illustrated as a rectangular shape, other shapes are equally functional, including rectangles, parallelograms, or other geometric shapes.

Overall dimensions of the rebound net device 10 are completely variable. In a preferred embodiment, a square frame structure has dimensions of nine feet in height by nine feet in width.

One primary function of the frame structure 12 is to maintain and provide a stationary reference for the elastic net 30. Another function of the frame structure 12 is to provide structural integrity to the rebound net device. Because, in a preferred embodiment, the rebound net is portable, the frame structure should be relatively lightweight, yet retain an appropriate level of rigidity. Accordingly, in one preferred embodiment, the rebound net frame structure is manufactured from a thermoplastic resin such as polyvinyl chloride. In another preferred embodiment, the frame structure is manufactured from a metal, such as steel or aluminum.

Attached to one side of the frame structure 12 are support legs 14. These support legs 14 provide means for holding the frame structure and elastic net 30 in place and at the desired vertical tilt angle. In a preferred embodiment, the support legs 14 are pivotally attached to the frame structure 12. Through the use of pivoting means, the support legs may be tilted with respect to the frame structure 12, thereby altering the vertical angle of the rebound net and accordingly, varying the return angle of the ball. In one such preferred embodiment, the pivoting means could be simple hinges or joints 16. Similar to the frame structure 12, in a preferred embodiment, the support legs are manufactured from a thermoplastic resin with an appropriate level of rigidity. Another preferred embodiment has the support legs manufactured from a metal material. It will be recognized by those with skill in the art that other materials can be use for manufacturing the frame structure and support legs used in the inventive device. All such materials are within the scope of the present invention.

Adjustment of the rebound net vertical angle is accomplished by varying the attachment angle of the support legs 14 with respect to the frame structure 14. Pivoting the support legs 14 away from the frame structure 12 increases the vertical angle of the frame structure 12 and elastic net 30; that is the frame structure is less perpendicular to the ground. In this position, a ball hit against the rebound net 10 will be returned at a high angle similar to a lob return. In such a configuration, the user may practice lobs as well as overhead returns. This feature has not previously been achieved in the known prior art.

By pivoting the support legs closer to the frame structure 12, the vertical angle of the frame structure and rebound net is increased; that is the frame structure is more perpendicular to the ground. In this position, a ball hit into the net would be returned to the athlete at a lower angle similar to a deep ground stroke.

As additional support for the rebound net 10, a preferred embodiment of the present invention includes support leg feet 18 providing additional ground friction and assisting in maintaining the position of the rebound net 10 during use. In the preferred embodiment including the pivoting support legs, the frame structure 12, and therefore the elastic net 30 vertical angle are easily adjusted by moving the bottom of the frame structure 12. This adjustment can be readily accomplished by adults and children. As such even beginning athletes can quickly adjust or set up the inventive rebound net to provide slower, higher returns for beginning practice.

The elastic net 30 is preferably maintained within the frame structure 12 by an adjustable tieing means 20. As used herein, the tension or rebound tension of the elastic net relates to the force necessary to stretch the elastic net as maintained within the frame structure. The adjustable tieing means can be either elastic or inelastic. Examples of preferred embodiments for elastic tieing means include bungee type cords or rubber tubing material. The use of an elastic tieing means may result in nonuniform net tension because tightening the elastic tieing means may stretch the elastic tieing means or could stretch the elastic netting material.

To address this issue, another preferred embodiment of the present invention uses an inelastic adjustable tieing means. When using an inelastic adjustable tieing means, the tightening of the tieing means results primarily in the stretching and tensioning of the netting material and not of the inelastic tieing means.

Figure 2:
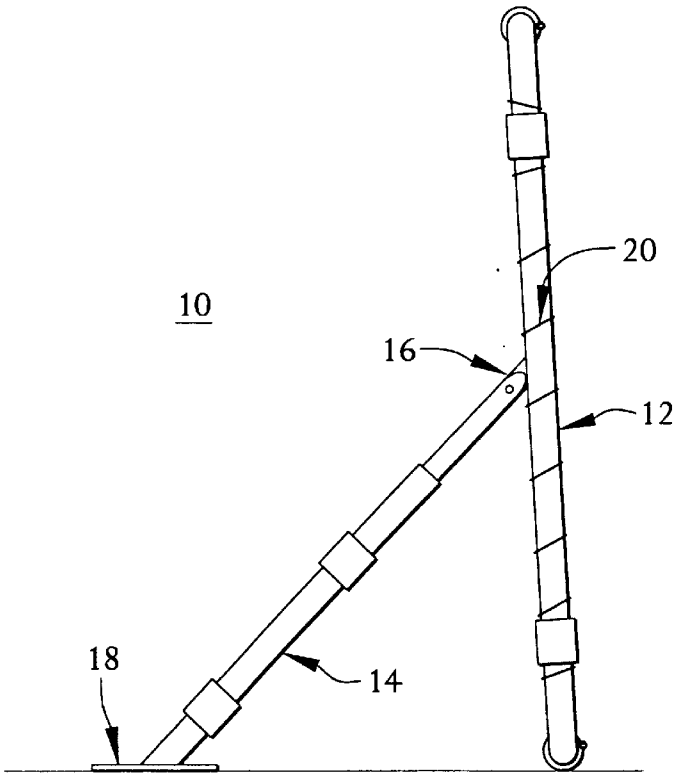
FIG. 2: is a side view of the frame structure and support legs.

As shown in FIG. 1 and FIG. 2, a preferred embodiment of the inelastic adjustable tieing means 20 is a cord material spirally wound around the edge of the elastic net 30 and the frame structure 12. By tightening or loosening the inelastic tieing means 20, the rebound net tension is increased or decreased respectively. An increase in the net tension will increase the return speed of the ball, while a decrease in the net tension will correspondingly decrease the return speed of the ball.

The cord material is preferably wound around the frame structure 12 and the elastic net 30 at approximately four to eight inch intervals. By winding the cord material at four inches or less intervals, a more uniform tensioning of the rebound net horizontal and vertical elements is achieved. If winding intervals of greater than twelve inches are used, the horizontal and vertical elements closest to the cord material will be under more tension than those horizontal and vertical elements further from the point where the cord material contacts the net edge. By lashing the elastic net 30 at larger winding intervals, there may be a difference in return speed of the rebounded ball as a function of the section of the net where the ball impacts. For example, if the ball impacts elastic elements under greater tension, the return speed will be higher, whereas, if the ball impacts elastic net elements under diminished tension, the return speed will be accordingly reduced.

Figure 3:
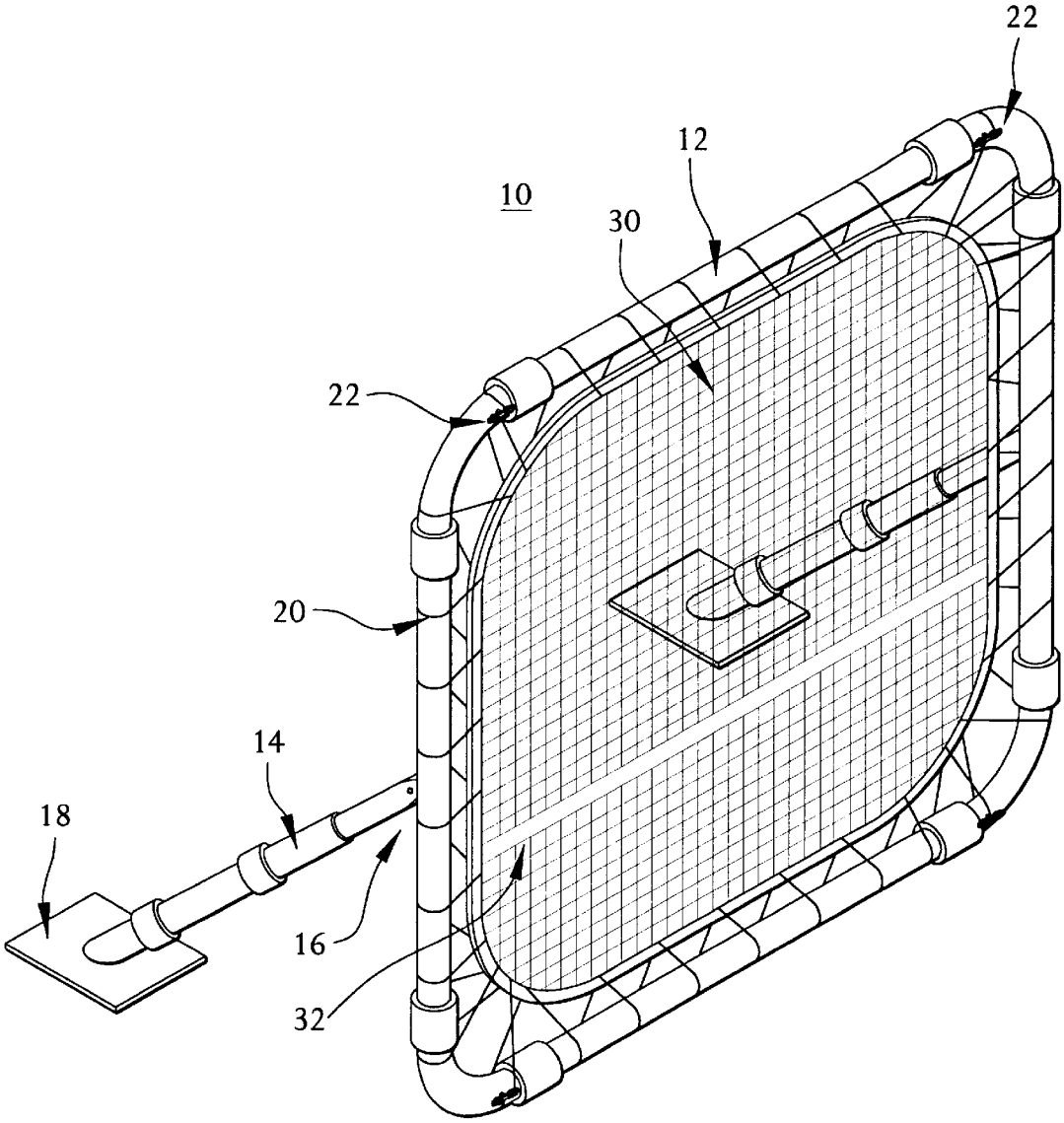
FIG. 3: is a side perspective view of a preferred embodiment of the rebound net invention.

FIGS. 1 and 2, show in a further preferred embodiment that the adjustable tieing means 20 is capable of being adjustably tightened or loosen at multiple locations along the frame structure 12. One preferred embodiment of the invention provides four corner locations where the adjustable tieing means 20 can be adjustably tightened or loosen, as shown in FIG. 3. In a preferred aspect, the adjustable tieing means 20 may be tied to a hook device 22 as illustrated in FIG. 3.

As a means of simulating the height of or the top tape of a tennis net, a preferred embodiment of the present invention includes a net stripe 32 woven into the elastic net 30. In this embodiment, shown in FIG. 1 and FIG. 2, the user readily observes whether he or she has hit the ball at an appropriate height to clear the net.

As described above and shown in FIG. 1 through FIG. 3, the portable rebound net 10 is primarily comprised of a frame structure 12, an elastic net 30, support legs 14, and the adjustable tieing means 20 used to maintain and adjust the tension of the elastic net 30 within the frame structure 12. Each of these elements is designed to be readily disassembled or removed, thereby increasing portability of the rebound net device 10.

In preferred embodiment, the adjustable tieing means 20 may be loosened from the hook devices 22, and then completely unwound from the elastic net 30 and frame structure 12, thereby releasing the elastic net 30 from the frame structure 12. In a further preferred embodiment, the frame structure is comprised of subsegments (not shown) which may be disconnected from each other for disassembly of the frame structure and for complete portability of the device. Moreover, in a preferred embodiment, the support legs 14 are removable from the frame structure during disassembly. In a further preferred embodiment for ease of portability, the support legs are telescoping (not shown) similar to camera tripod legs.

The above detailed description teaches certain preferred embodiments of the present invention adjustable rebound net. While preferred embodiments have been described and disclosed, it will be recognized by those skilled in the art that modifications are possible and such modifications are within the true scope and spirit of the present invention. It is likewise understood that the attached claims are intended to cover all such modifications.

| List of Drawings Reference Numbers | |
|---|---|
| 10 | Rebound net |
| 12 | Frame structure |
| 14 | Support legs |
| 16 | Support leg pivot joint |
| 18 | Support leg feet |
| 20 | Adjustable tieing means |
| 22 | Frame structure tieing means hook |
| 30 | Elastic net |
| 32 | Net stripe |

What is claimed is:

1. A portable rebound net comprising:

a frame structure including a first and a second cylindrical vertical member and a first and a second cylindrical horizontal member;

support legs attached to said frame structure;

an elastic net material disposed within said frame structure; and a plurality of tieing cords, a respective single cord spirally wound around each respective one of said vertical and horizontal members, said cord further interlaced with said net material thereby securing said net material to said frame structure, each cord providing uniform tension along the length of each of said respective vertical and horizontal members.

2. The portable rebound net of claim 1, wherein the support legs are pivotally attached to the frame structure for tilting the frame structure and elastic net, and therefore the return angle of a rebounded ball.

3. The portable rebound net of claim 1, wherein the frame structure and support legs are manufactured from the group consisting of thermoplastic resins including polyvinyl chloride and its copolymers, compounds and derivatives.

4. The portable rebound net of claim 1, wherein the frame structure and support legs are manufactured from the group consisting of metals including steel, aluminum and their alloys and derivatives.

5. The portable rebound net of claim 1, further comprising four corner portions, each of the plurality of cords being adjustably attached to at least a respective one of the corner portions.

6. The portable rebound net of claim 1, further comprising four corner portions, each of the plurality of cords being adjustably attached to a respective pair of the corner portions.

7. The portable rebound net of claim 1, wherein each single tieing cord is tied to a respective corner portion at each respective end of said cord.

8. The portable rebound net of claim 1, wherein each tieing cord is wound spirally around its respective frame member at approximately four to eight inch intervals.

9. A method for assembling a portable rebound net comprising the steps of:

(a) providing a frame structure including a first and a second cylindrical vertical member and a first and a second cylindrical horizontal member, support legs attached to said frame structure, an elastic net disposed within said frame structure, and a plurality of tieing cords;

(b) spirally winding a respective single one of the plurality of tieing cords around each respective one of said vertical and horizontal members; and (c) interlacing said cord with said net, thereby securing said net to said frame structure, each cord providing uniform tension along a respective side of the elastic net.

10. The method of claim 9, wherein the rebound net has four corner portions, the method further comprising the step of adjustably attaching each of the plurality of cords to at least a respective one of the corner portions.

11. The method of claim 9, wherein the rebound net has four corner portions, the method further comprising the step of adjustably attaching each of the plurality of cords to a respective pair of the corner portions.

12. The method of claim 9, wherein each single tieing cord is tied to a respective corner portion at each respective end of said cord.

13. The method of claim 9, wherein the step of spirally winding each tieing cord includes spirally winding said cord around its respective frame member at approximately four to eight inch intervals.

* * * * *